US007685738B2

(12) United States Patent
Jones

(10) Patent No.: US 7,685,738 B2
(45) Date of Patent: Mar. 30, 2010

(54) COMPUTER TO PLATE COLOR SENSOR AND DRYING/CURING SYSTEM AND METHOD

(75) Inventor: Phillip E. Jones, Little Elm, TX (US)

(73) Assignee: Printing Research, Inc., Dallas, TX (US)

( * ) Notice: Subject to any disclaimer, the term of this patent is extended or adjusted under 35 U.S.C. 154(b) by 496 days.

(21) Appl. No.: 11/216,861

(22) Filed: Aug. 31, 2005

(65) Prior Publication Data

US 2006/0177760 A1 Aug. 10, 2006

Related U.S. Application Data

(63) Continuation-in-part of application No. 11/051,277, filed on Feb. 4, 2005, now Pat. No. 7,225,560.

(51) Int. Cl.
*F26B 3/34* (2006.01)

(52) U.S. Cl. ..... 34/245

(58) Field of Classification Search ..... 34/245, 34/259, 266, 275; 430/245, 328; 250/319, 250/222.1, 275.5; 118/641
See application file for complete search history.

(56) References Cited

U.S. PATENT DOCUMENTS 3,748,089 A 7/1973 Boyer, et al
4,363,176 A 12/1982 Jargiello et al.
4,410,560 A * 10/1983 Kosterka ..... 427/504
4,485,565 A 12/1984 Ertl et al.
4,554,437 A 11/1985 Wagner et al.
5,020,237 A 6/1991 Gross et al.
5,094,010 A * 3/1992 Jacobi et al. ..... 34/278
5,948,595 A 9/1999 Watanabe
5,966,836 A 10/1999 Valdez, III et al.
6,040,113 A 3/2000 Van Damme et al.
6,294,114 B1 9/2001 Muirhead
6,352,811 B1 3/2002 Patel et al.
6,352,812 B1 3/2002 Shimazu et al.
6,458,510 B1 10/2002 Vermeersch et al.
6,558,875 B1 5/2003 Toshimitsu et al.

(Continued)

FOREIGN PATENT DOCUMENTS

DE 1955378 5/1972

(Continued)

OTHER PUBLICATIONS

"International Search Report and Written Opinion," PCT/US2006/003451, May 23, 2006, 12 pgs.

(Continued)

*Primary Examiner*—Kenneth B Rinehart
(74) *Attorney, Agent, or Firm*—Michael W. Piper; Conley Rose, P.C.

(57) ABSTRACT

A printing plate curing system includes a color sensor that measures at least one color value of a printing plate. The color value is used to control a parameter of a curing system, such as energy output or conveyor speed. Multiple color sensors may be used to measure color values of a printing plate before and after imaging, developing and curing. Each sensor may measure multiple color values. The measure values may be used to control an imager as well as a curing system.

22 Claims, 6 Drawing Sheets

U.S. PATENT DOCUMENTS

| | | | | |
|---|---|---|---|---|
| 6,597,455 | B1 * | 7/2003 | Wlodarski et al. | 356/430 |
| 6,599,676 | B2 | 7/2003 | Savariar-Hauck et al. | |
| 6,620,582 | B2 | 9/2003 | Hirabayashi | |
| 6,675,710 | B2 | 1/2004 | Friedman et al. | |
| 6,677,106 | B2 | 1/2004 | Blum et al. | |
| 6,707,014 | B1 | 3/2004 | Corey et al. | |
| 6,716,566 | B2 | 4/2004 | Aoshima | |
| 6,861,202 | B2 | 3/2005 | Toshimitsu et al. | |
| 7,225,560 | B2 | 6/2007 | Govek et al. | |
| 2002/0001776 | A1 | 1/2002 | Mori et al. | |
| 2002/0144991 | A1 | 10/2002 | Fromson et al. | |
| 2002/0177071 | A1 | 11/2002 | Okamoto | |
| 2003/0118949 | A1 | 6/2003 | Ray et al. | |
| 2003/0124454 | A1 | 7/2003 | Savariar-Hauck et al. | |
| 2003/0157429 | A1 | 8/2003 | Blum et al. | |
| 2003/0200885 | A1 | 10/2003 | Shimazu et al. | |
| 2003/0200886 | A1 | 10/2003 | Vermeersch et al. | |
| 2003/0219673 | A1 | 11/2003 | Tao et al. | |
| 2003/0224284 | A1 | 12/2003 | Tao | |
| 2005/0037287 | A1 | 2/2005 | Verschueren et al. | |
| 2005/0048404 | A1 | 3/2005 | Okamoto | |

FOREIGN PATENT DOCUMENTS

| | | | |
|---|---|---|---|
| DE | 2201936 | | 7/1973 |
| DE | 2648438 | B1 | 12/1978 |
| DE | 10035430 | A1 | 2/2002 |
| EP | 0982627 | A2 | 3/2000 |
| EP | 1 074 889 | A2 | 2/2001 |
| EP | 1 176 031 | A1 | 1/2002 |
| EP | 1 356 927 | A2 | 10/2003 |
| GB | 1330139 | | 9/1973 |
| GB | 1413374 | | 11/1975 |
| GB | 2205419 | A | 12/1988 |
| JP | 2002/343697 | | 11/2002 |
| WO | 2005015318 | A1 | 2/2005 |
| WO | WO 2005/052694 | A2 | 6/2005 |

OTHER PUBLICATIONS

International Search Report and Written Opinion, PCT/US2006/003849, Jun. 11, 2006, 15 pages.

Office Action dated Mar. 23, 2006, 12 pages, U.S. Appl. No. 11/051,277, filed Feb. 4, 2005.

Office Action dated Aug. 28, 2006, 19 pages, U.S. Appl. No. 11/051,277, filed Feb. 4, 2005.

Final Office Action dated Jan. 30, 2007,11 pages, U.S. Appl. No. 11/051,277, filed Feb. 4, 2005.

Notice of Allowance and Fee(s) Due dated Mar. 26, 2007, 8 pages, U.S. Appl. No. 11/051,277, filed Feb. 4, 2005.

* cited by examiner

COMPUTER TO PLATE COLOR SENSOR AND DRYING/CURING SYSTEM AND METHOD

CROSS-REFERENCE TO RELATED APPLICATIONS

This application is a continuation-in-part of and claims priority to U.S. application Ser. No. 11/051,277 filed Feb. 4, 2005, and entitled "Computer to Plate Curing System," by Jeffrey P. Govek, et al, which is incorporated herein by reference for all purposes.

STATEMENT REGARDING FEDERALLY SPONSORED RESEARCH OR DEVELOPMENT

Not applicable.

REFERENCE TO A MICROFICHE APPENDIX

Not applicable.

Field of the Invention

The present disclosure is directed to a system for printing presses, and more particularly, but not by way of limitation, to a system for curing an imaged printing plate.

Background of the Invention

Lithographic printing is based on the immiscibility of oil and water, wherein the oily ink material preferentially adheres to the image areas and the water or fountain solution preferentially adheres to the non-image areas. When a suitably prepared printing plate is moistened with water and an ink is then applied, the non-image areas adhere the water and repel the ink while the image areas adhere the ink and repel the water. The ink on the image areas of the printing plate is then transferred to a substrate, for example paper, perhaps after first being transferred to an intermediate surface and from the intermediate surface to the substrate.

Printing plates may be composed of a thin layer of sensitive chemicals on an aluminum plate. Imaging or exposing the printing plates causes the chemicals to react, leaving some regions exposed and other regions unexposed. After imaging, the printing plates are developed. According to one method of developing, the printing plates are treated in one or more chemical baths to remove exposed or non-exposed areas while leaving other areas in place. When properly developed, the printing plate exhibits the immiscibility of oil and water properties discussed above. Printing plates may be imaged using a variety of technologies including ultraviolet, infrared, and visible wavelength light radiated through a mask or using an infrared laser or other laser.

An imaged and developed printing plate may be cured or baked to increase the run life of the printing plate. Printing plates may be able to print many thousands of copies, for example for a newspaper edition or an issue of a magazine. Some printing runs, however, produce so many copies that several sets of printing plates wear out and need replacing through the course of the printing run. Generally it is desirable to be able to extend printing plate life by curing or baking printing plates. Curing may be defined as the operation of heating the emulsion or active composition on the printing plate to a sufficient temperature to make the emulsion more durable, as is well known in the art. Conventional curing has been performed by passing an imaged and developed printing plate through a convection oven to raise the plate temperature to a narrow temperature range required to achieve curing while avoiding overheating that can damage the layer of chemicals or weaken the aluminum plate. For negative plates, an imaged plate may be heated in a second convection oven after imaging and before developing. Curing is often referred to as baking because of the convection ovens used for curing. However, it has proven difficult to precisely control the temperature in such ovens and in particular to provide a uniform temperature on all parts of a printing plate. Nonuniform heating results in nonuniform curing and therefore nonuniform printing characteristics for the finished plate.

SUMMARY OF THE INVENTION

A system and method for controlling production of printing plates using a color sensor to measure at least one color value of a printing plate.

In one embodiment, a color sensor measures a color value of a printing plate after curing in a curing chamber and a parameter of the curing chamber may be adjusted if curing is above or below a desired value.

In one embodiment, at least one color sensor is coupled to a control system, and the control system is coupled to the curing system and automatically controls parameters of the curing system.

In one embodiment, a color sensor measures a color value of a printing plate while it is in a curing chamber and a parameter of the curing chamber may be adjusted during curing.

In one embodiment, at least two color sensors measure a color value of a printing plate before and after curing and a control system uses the difference, e.g. percentage change or absolute value change, in measured values to adjust a parameter of the curing system, if needed, to achieve a desirable level of curing.

In one embodiment, measured color values may be used to adjust operating parameters of an imaging system to improve overall plate production.

These and other features and advantages will be more clearly understood from the following detailed description taken in conjunction with the accompanying drawings and claims.

BRIEF DESCRIPTION OF THE DRAWINGS

For a more complete understanding of the present disclosure and the advantages thereof, reference is now made to the following brief description, taken in connection with the accompanying drawings and detailed description, wherein like reference numerals represent like parts.

DETAILED DESCRIPTION OF THE PREFERRED EMBODIMENTS

It should be understood at the outset that although an exemplary implementation of one embodiment of the present disclosure is illustrated below, the present system may be implemented using any number of techniques, whether currently known or in existence. The present disclosure should in no way be limited to the exemplary implementations, drawings, and techniques illustrated below, including the exemplary design and implementation illustrated and described herein.

Some imaged and developed printing plates may experience longer run lives if they are first cured before use, for example by irradiating with heat or with ultraviolet light in accordance with the present invention. It is desirable to control the radiation applied to the printing plates carefully to properly cure the printing plates. Excessive radiation levels and/or irradiating too long may degrade the printing plate image and/or the metallurgical properties of the aluminum backing of the printing plate. For example, excessive heat may increase the malleability of the aluminum backing and thereby reduce the run life of the printing plate. Inadequate irradiation and/or curing for too short a time interval may not fully cure the printing plate. Hot air convection ovens for curing printing plates support control of a temperature set point and the length of time of heating, but do not support control of differential heating across the area of the printing plate. Convection ovens require time to bring a heating chamber up to the temperature set point. Because of the time required to achieve the temperature set point, convection ovens may be left continuously on during operating hours, which may waste energy resources in some cases. Convection ovens may be large and bulky. An alternative curing apparatus which can rapidly achieve the temperature set point and promotes differential curing across the area of the printing plate may be helpful.

Figure 1A:
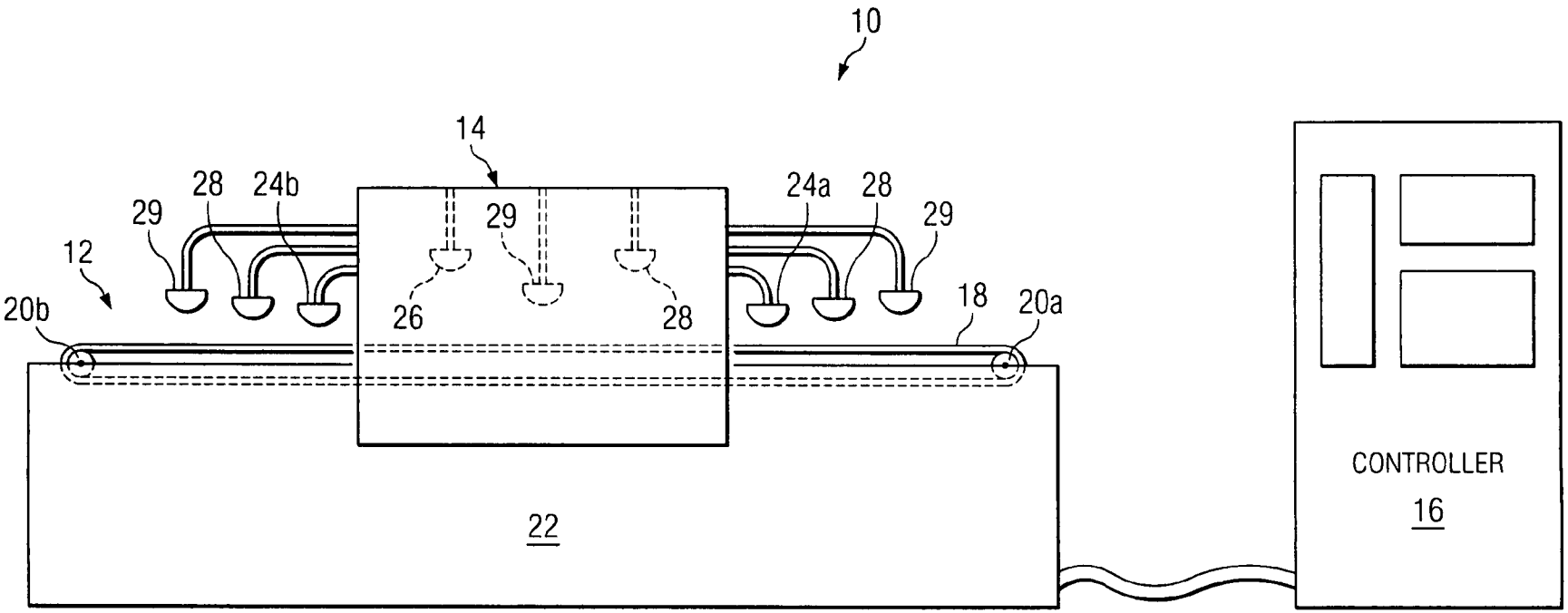
FIG. 1*a* is a diagram of a curing system according to an embodiment of the present disclosure.

Turning now to FIG. 1*a*, a curing system 10 is illustrated. A conveyer 12 is operable to move an imaged and developed printing plate into, through, and out of a curing chamber 14. The conveyer 12 may move the printing plate into and out of the curing chamber 14 using continuous motion. Alternately, the conveyer 12 may move the printing plate into the curing chamber 14 and stop, the printing plate may be irradiated with energy in the curing chamber, and the conveyer 12 may then move the printing plate out of the curing chamber 14 and stop, which may be referred to as discontinuous motion. The curing chamber 14 is operable to differentially irradiate the printing plate under the control of a controller 16 as the conveyer 12, also under the control of the controller 16, moves the printing plate through the curing chamber 14 using either continuous or discontinuous motion. The conveyer 12 may comprise a conveyer belt 18 supported by two or more conveyer rollers 20. In FIG. 1, two rollers 20 are depicted—a first conveyer roller 20*a* and a second conveyer roller 20*b*—but in another embodiment more rollers 20 may be employed to provide the needed support to the conveyer belt 18. At least one of the rollers 20 is coupled to an electric motor which rotates the roller 20, and hence provides linear motion to the conveyer belt 18 through the curing chamber 14, under the command of the controller 16. The conveyer belt 18 may be moved at different speeds by the roller 20, as commanded by the controller 16. In an embodiment, more than one of the rollers 20 may be coupled to the same motor or different motors to provide motive force to the conveyer belt 18. The conveyer 12 and the curing chamber 14 may be supported by a frame structure 22.

A first edge detector 24*a* may be employed to detect entry of the printing plate into the curing chamber 14. A second edge detector 24*b* may be employed to detect exit of the printing plate from the curing chamber 14. One or more temperature sensors 26 may be located in the curing chamber 14 to monitor temperature of the curing chamber 14 or the printing plate. One or more infrared thermocouples 29 may be located inside and/or outside the curing chamber 14 to monitor the temperature of a printing plate. One or more color sensors 28 may be located inside and/or outside the curing chamber 14 to monitor the color or colors within specific bandwidths of the printing plate as it enters and/or exits the curing chamber 14 and/or while the printing plate is in or passing through the curing chamber 14. The color sensors may be positioned to monitor various areas on a printing plate, e.g. an edge or the center, or to take an average reading over an area. The color sensors 28 may include calorimeters, color densitometers, spectrophotometers, and/or other color sensor devices.

Figure 1B:
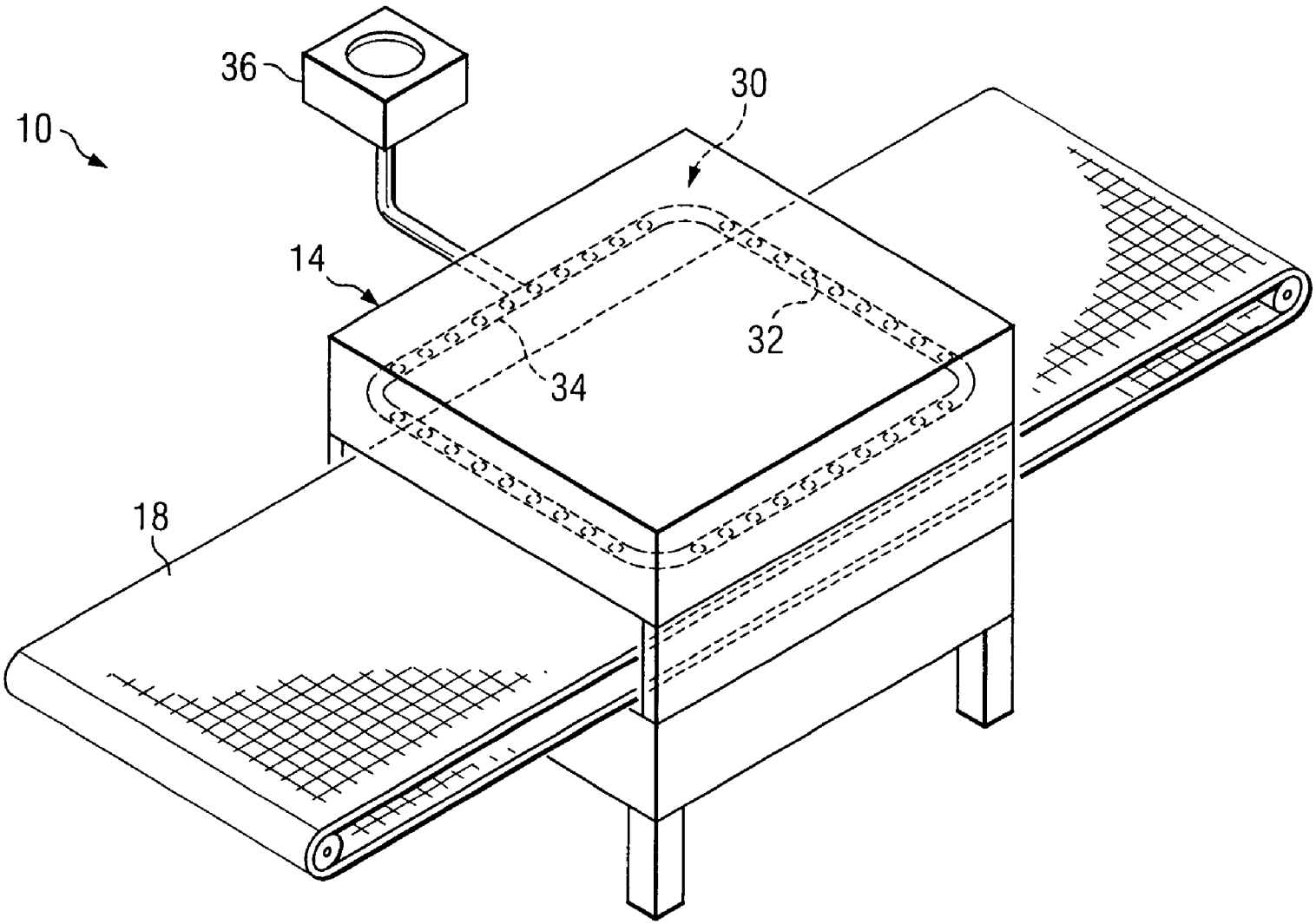
FIG. 1*b* is a diagram of an extraction system coupled to the curing system according to an embodiment of the present disclosure.

Turning now to FIG. 1*b*, an embodiment of the curing system 10 including an extraction system 30 is depicted. The extraction system 30 is operable to draw air, gases, and air suspended particles out of the curing chamber 14. The extraction system 30 removes matter which may ablate from the printing plates as they cure. The extraction may prevent or diminish the deposition of ablated material on the interior of the curing chamber 14 and the risk that deposited material may ablate off the interior of the curing chamber 14 and fall onto the printing plates, damaging the printing plates. The extraction system 30 may also be employed to cool the interior of the curing chamber 14 between printing plates, the cooling operation taking place at least partly through the action of convective cooling.

The extraction system 30 comprises a plurality of ports 32 disposed above and proximate to the conveyer belt 18. In this embodiment, the ports are distributed along the inside of both sides and both ends of the curing chamber 14. The ports 32 may be perforations of a conduit 34 attached to the interior of the curing chamber 14. The conduit 34 is attached to a source of low pressure air 36, for example a multi-speed fan. In an alternate embodiment, the ports 32 perforate the side walls of the curing chamber 14, an external manifold is attached sealingly to the side walls of the curing chamber 14, and the source of low pressure air 36 is attached to the external manifold. In an embodiment, the ports 32 and conduit 34 may be located only on the side walls of the chamber 14, parallel to the direction of motion of the printing plates passing through the curing chamber 14. The pressure differential between ambient pressure and the pressure provided by the source of low pressure air 36 may be increased to increase in-flow of air when cooling operations are conducted, for example by increasing the speed of a multi-speed fan. The source of low pressure air 36 may scrub or otherwise remove undesirable gases and particulate matter before venting to ambient. Ambient air may enter chamber 14 through openings in the ends of chamber 14 through which the conveyer 18 passes. The source of low pressure air 36 may be attached by one or more pipes or flexible hoses to the conduit 34 or external manifold. In an embodiment, a plurality of sources of low pressure air 36 may be employed.

Figure 2A:
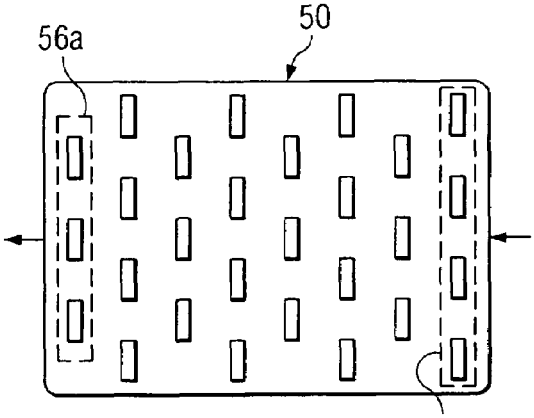
FIG. 2*a* is a diagram depicting alignment of an upper array of energy radiators, including zones, according to an embodiment of the present disclosure.
Figure 2B:
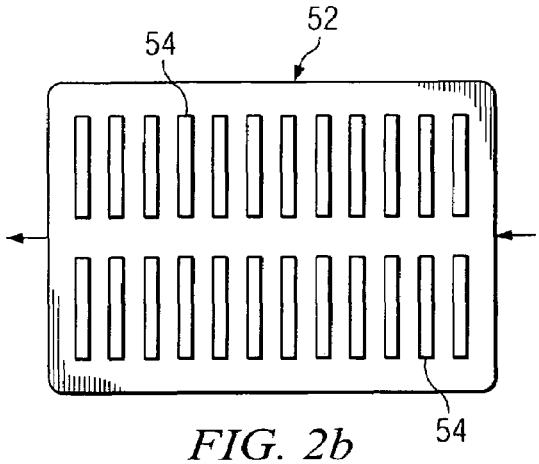
FIG. 2*b* is a diagram depicting alignment of a lower array of energy radiators according to an embodiment of the present disclosure.

Turning now to FIGS. 2*a* and 2*b*, an upper radiator array 50 and a lower radiator array 52 are illustrated. The upper radiator array 50 and the lower radiator array 52 are both components of the curing chamber 14. The upper radiator array 50 is disposed above conveyer belt 18, and the lower radiator array 52 is disposed below the conveyer belt. Both the plane of the upper radiator array 50 and the plane of the lower radiator array 52 are disposed substantially parallel to the plane of the conveyer belt 18. The conveyer belt 18 is substantially transparent to energy radiation and preferably to airflow and is therefore referred to as energy transparent. The conveyer belt 18 may be formed of a mesh material, a webbing material, a net-like material, or an energy transparent material. It may be preferable that the material of the conveyer belt 18 tend to not absorb and/or retain heat energy. When formed of a mesh or webbing material, the structural elements of the mesh or webbing may not themselves be energy transparent, but the spaces between the structural elements are open allowing transmission of radiant energy and airflow for convective or forced air heating and cooling. The conveyer belt 18 may be formed of a substantially continuous sheet or film of substantially energy transparent material allowing energy radiated by the lower radiator array 52 to directly irradiate the bottom of the printing plate, through the energy transparent material. In an embodiment, the conveyer belt 18 may comprise a pair of tracks driven synchronously by the one of the rollers 20, the tracks so disposed to fittingly receive the printing plate.

Both the upper radiator array 50 and the lower radiator array 52 include a plurality of energy radiators 54. Each energy radiator 54 may be individually controlled by the controller 16. In this embodiment, the energy radiators 54 are linear lamps, the energy radiators 54 in the upper radiator array 50 and the energy radiators 54 in the lower radiator array 52 are aligned substantially perpendicular to, the direction of travel of the conveyer 12. In other embodiments, the alignment of energy radiators 54 in the upper radiator array 50 and the energy radiators 54 in the lower radiator array 52 may be perpendicular, parallel, or biased with respect to the direction of travel of the conveyer 12. In the preferred embodiment, the upper radiator array 50 comprises 67 individual energy radiators 54. In another embodiment, other alignments of the energy radiators 54 may be employed. In the preferred embodiment, the energy radiators 54 are linear tungsten halogen lamp infrared radiator elements. In alternative embodiments the energy radiators 54 may be Calrod™ infrared radiator elements or other energy radiators. In the preferred embodiment, the energy radiators 54 disposed in the upper radiator array 50 are each rated to radiate up to a maximum of 1 kW and the energy radiators 54 disposed in the lower radiator array 52 are each rated to radiate up to a maximum of 2 kW. In another embodiment, a different energy radiator 54, for example an ultraviolet lamp, may be employed.

In an embodiment, the interior surfaces of the upper radiator array 50, the lower radiator array 52, and the curing chamber 14 may be formed of or coated with a material having low thermal capacity and low thermal conductivity so that energy radiated by the upper radiator array 50 and the lower radiator array 52 is not absorbed and reemitted undesirably. Alternately, some of the surfaces of the upper radiator array 50, the lower radiator array 52, and/or the curing chamber 14 may be covered with fiberglass sheets covered with a thin reflective metal sheet.

The energy radiators 54 may be controlled by the controller 16 to effect zoned energy radiation. For example, a first radiation zone 56 may be comprised of the energy radiators 54 on the leading and trailing edges of the upper radiator array 50. The energy radiators 54 which comprise the first radiation zone 56 may be supplied the same power levels by the controller 16. Alternately, a second radiation zone 56*a* may be defined comprised of the energy radiators 54 on the leading edge of the upper radiator array 50 while a third radiation zone 56*b* may be defined comprised of the energy radiators 54 on the trailing edge of the upper radiator array 50. The energy radiators 54 which comprise the second radiation zone 56*a* may be supplied a different power level by the controller 16 from the power level supplied by the controller 16 to the third radiation zone 56*b*.

Figure 2C:
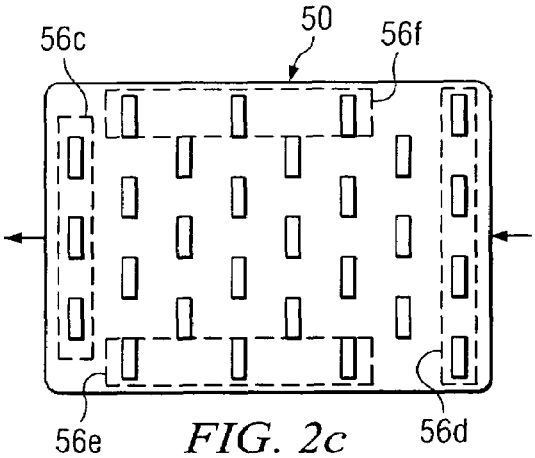
FIG. 2*c* is a diagram depicting alternate radiation zones of an upper array of energy radiators according to an embodiment of the present disclosure.
Figure 2D:
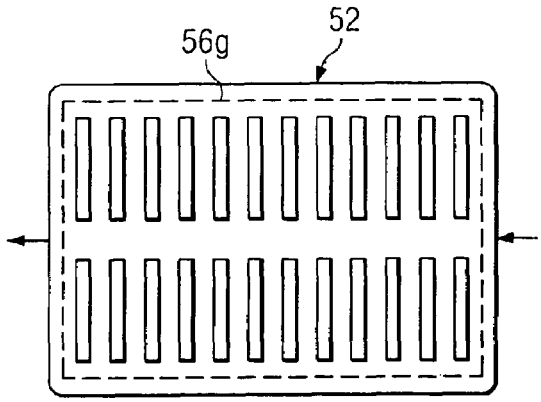
FIG. 2*d* is a diagram depicting a radiation zone of a lower array of energy radiators according to an embodiment of the present disclosure.

Turning now to FIG. 2*c* and 2*d*, an alternate zoning of energy radiators 54 is depicted. A fourth radiation zone 56*c* is composed of some energy radiators 54 on the leading edge and a fifth radiation zone 56*d* is composed of some energy radiators 54 on the trailing edge of the upper radiator array 50. A sixth radiation zone 56*e* and a seventh radiation zone 56*f* are composed of the energy radiators 54 on either side of the upper radiator array 50. An eighth radiation zone 56*g* is composed of all the energy radiators 54 on the lower radiator array 52. The five radiation zones 56*c*, 56*d*, 56*e*, 56*f*, and 56*g* have been demonstrated to advantageously cure printing plates in a laboratory prototype. It may be that the fifth radiation zone 56*d* raises the energy level of the printing plate as it enters the curing chamber 14 to just below the operable curing energy level of the printing plate. The fourth radiation zone 56*c*, under which the printing plate passes when exiting the curing chamber 14, may provide the last increment of energy to cause the curing process to occur. The sixth radiation zone 56*e* and the seventh radiation zone 56*f* may maintain the energy levels near the edges of the printing plate which otherwise may be subject to energy loses at the edges of the curing chamber 14. In using the laboratory prototype, the sixth radiation zone 56*e* and the seventh radiation zone 56*f* were found necessary to cure outside edge portions of the printing plates. The eighth radiation zone 56*g* may reduce or prevent laminar energy differentials in the aluminum backing of the printing plate which otherwise may undesirably warp the printing plate.

The plurality of energy radiators 54 in both the upper radiator array 50 and the lower radiator array 52 promote flexible definition of radiation zones, for example the radiation zones 56, 56*a*, 56*b*, 56*c*, 56*d*, 56*e*, 56*f*, and 56*g*. In an embodiment, however, fewer energy radiators 54 may be deployed in the upper radiator array 50 and/or the lower radiator array 52 and one or more radiation zones may be permanently defined. As practical knowledge of the effects of zoned radiation is gained in the field, it may be preferable to deploy the upper radiator array 50 and the lower radiator array 52 with fewer energy radiators 54 and permanently defined radiation zones as a design simplification which reduces manufacturing cost and increases system reliability.

In an embodiment, the one or more temperature sensors 26 may include one or more infrared sensors, e.g. infrared thermocouples, responsive to a range of temperatures which the printing plate, for example a printing plate, may be expected to exhibit during the curing process, but unresponsive to the higher temperatures associated with the energy radiators 54. In an embodiment, a plurality of infrared sensors may be disposed to provide a low resolution image, for example a four-by-four pixel image or an eight-by-eight pixel image, of the temperature of one or both surfaces of the printing plate. In an embodiment, several infrared sensors may be deployed in substantially a single file and positioned near where the printing plate exits from the curing chamber 14. In an embodiment, a forward looking infrared (FLIR) sensor may provide a high resolution image of the temperature of one or both surfaces of the printing plate.

Figure 3:
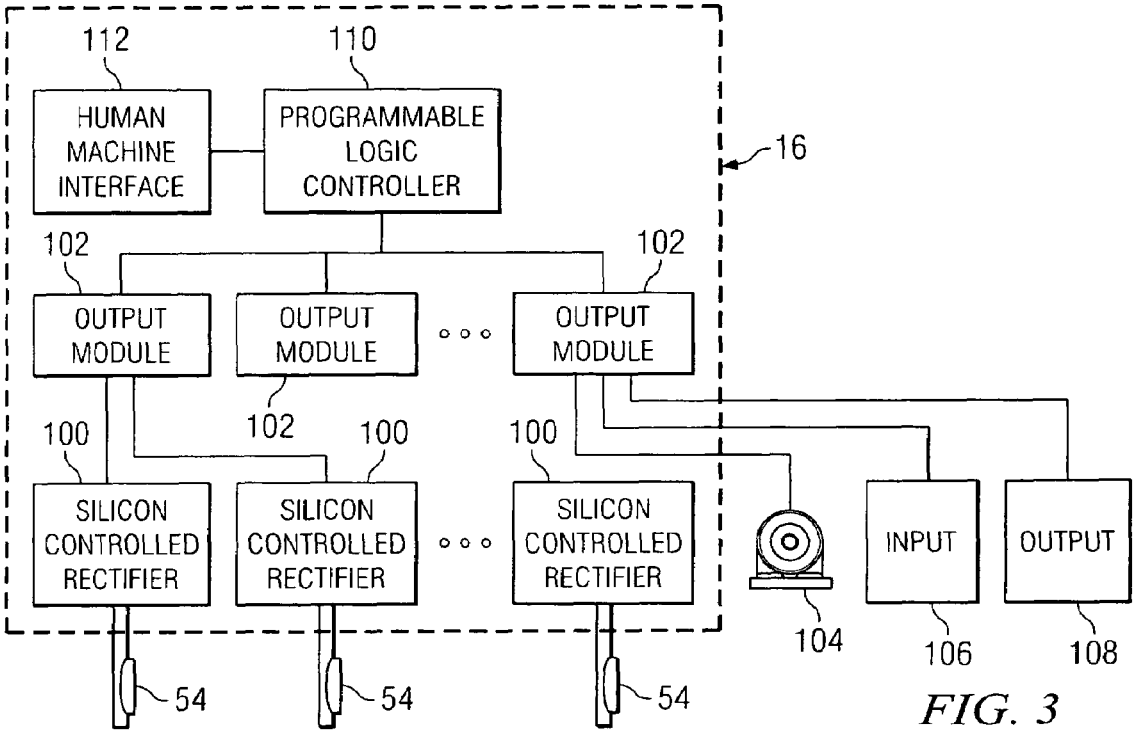
FIG. 3 is a block diagram of a system for controlling a plurality of energy radiators according to an embodiment of the present disclosure.

Turning now to FIG. 3, some of the components of the controller 16 are depicted coupled to components of the curing system 10. A plurality of power controllers 100 are coupled to electrical power supplies (not shown) and deliver variable electrical power to the energy radiators 54 in response to a control input. The power controllers 100 may be silicon controlled rectifier (SCR) based power controllers, solid state relays, duty cycle control components, or other power throttling type of device. A plurality of output modules 102 are operable to control the power controllers 100 and a conveyer motor 104. The output modules 102 may also interface to one or more discrete inputs 106 and one or more discrete outputs 108. The discrete input 106 may include an edge detection indication, for example from the first edge detector 24*a*, when the printing plate enters the curing chamber 14. The discrete output 108 may turn on a red light, for example, when the curing chamber 14 is hot. The output modules 102 are controlled by a programmable logic controller (PLC) 110. Generally, a PLC 110 is a computer adapted to performing automation control activities. A human machine interface (HMI) 112 provides a means for an operator to define operating scenarios, to activate predefined operating scenarios, and to operate the curing system 10 manually. In an embodiment, the HMI 112 may be provided by a general purpose computer system which executes computer programs. In an embodiment, the functions of the PLC 110 and the HMI 112 may be combined in a single general purpose computer system.

In the preferred embodiment, the PLC 110 is an off the shelf item available from Allen Bradley as model SLC 5/03. In the preferred embodiment, the HMI 112 is available from Red Lion Controls, 20 Willow Springs Circle, York, Pa. 17402, USA. In the preferred embodiment, the power controller 100 is a SCR based power controller from Avatar with model number A1P-2430 or A3P4800. In other embodiments, other PLCs 110, power controllers 100, and/or HMI 112 may be employed.

The HMI 112 may provide a curing scenario creation tool which promotes ease of defining new curing scenarios or curing recipes. The curing scenarios or curing recipes may be stored in the HMI 112. The curing scenario creation tool may request a user to define an energy radiation level ramp-up time interval during which the radiation level of the energy radiators 54 are ramped up, a sustained radiation level time interval during which the radiation level of the energy radiators 54 are maintained at a constant high level, and a ramp-down time interval during which the radiation level of the energy radiators 54 are ramped down. Ramping-up and ramping-down the power levels supplied to the energy radiators 54 may extend the life of the energy radiators 54, conserve energy consumption, and/or better balance radiation. The curing scenario creation tool may request the user to define a maximum scenario weighting coefficient $C_s$ in the range 0.0 to 1.0. The curing scenario creation tool may request the user to define a weighting coefficient $C_w$ for each energy radiator 50 in the range from 0.0 to 1.0. The output of any energy radiator may then be controlled as:

$$P(t)=C_r(t)*C_s*C_w*P_{max} \quad (1)$$

Where P(t) is the power supplied to the energy radiator 50 as a function of time, $C_r(t)$ is a function of time that represents ramping the power output of the energy radiator 50 up and down and $P_{max}$ is the maximum power output capability of the energy radiator 50. The ramping time function $C_r(t)$ will be equal to 1.0 during the sustained radiation time interval, will ramp linearly with time from 0.0 to 1.0 during the ramp-up time interval, will ramp linearly with time from 1.0 to 0.0 during the ramp-down time interval, and will be 0.0 before the start of the radiation period or the ramp-up interval. Alternately, the ramping time function $C_r(t)$ may linearly ramp up from and ramp-down to some minimum level, for example 0.2. Maintaining the power supplied to the energy radiators 54 at a minimum level may promote more rapid energy delivery from the energy radiators 54 because there may be some time and energy overhead involved in performing a "cold start" curing operation. The ramp-up interval may commence when the printing plate is moved by the conveyer 12 into the curing chamber 14, for example as determined by an edge detector 24 that may provide a discrete input 106.

Figure 4:
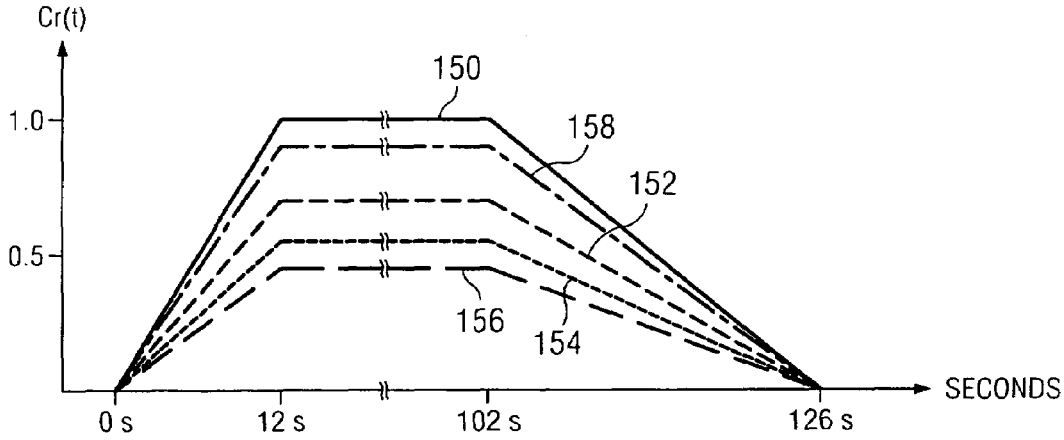
FIG. 4 is a graph of a ramping time function and individual power profiles for radiation zones according to one embodiment of the disclosure.

Turning now to FIG. 4, a graph illustrates a first ramping time function $C_r(t)$ 150 and several power profiles, i.e. power as a function of time, P(t) for the exemplary radiation zones 56*c*, 56*d*, 56*e*, 56*f*, and 56*g* defined in FIG. 2*c* and 2d versus time. The first power profile $C_r(t)$ 150 may have been defined using the curing scenario creation tool. The time scale 0 position is located where the printing plate is first detected entering the curing chamber 14, as for example by the first edge detector 24*a*. The ramp-up time interval has been defined to be 12 seconds, and the graph shows $C_r(t)$ 150 linearly increasing from 0 at 0 seconds to 1 at 12 seconds. The sustained radiation level time interval has been defined to be 90 seconds, and the graph shows $C_r(t)$ 150 maintaining at a value of 1 for 90 seconds from 12 seconds after edge detection of the printing plate to 102 seconds after edge detection of the printing plate, an interval of 90 seconds. The ramp-down time interval has been defined to be 24 seconds, and the graph shows $C_r(t)$ 150 linearly decreasing from 1 at 102 seconds to 0 at 126 seconds.

For the exemplary curing scenario depicted by FIG. 4, the value of $C_s$ is 0.9 and the value of $P_{max}$ is 1.0 for the P(t) for each of the radiation zones 56*c*, 56*d*, 56*e*, 56*f*, and 56*g*. The weighting coefficient of the eighth radiation zone 56*g* $C_{w,8}$=0.5, the seventh radiation zone 56*f* $C_{w,7}$=0.6, the sixth radiation zone 56*e* $C_{w,6}$=0.6, the fifth radiation zone 56*d* $C_{w,5}$=0.8, and the fourth radiation zone 56*c* $C_{w,4}$=1.0. These weightings, used in the equation (1) above, lead to a graph of a first power profile $P_1(t)$ 152 representing power supplied to the fifth radiation zone 56*d*, a graph of a second power profile $P_2(t)$ 154 representing power supplied to the sixth radiation zone 56*e* and to the seventh radiation zone 56*f*, a graph of a third power profile $P_3(t)$ 156 representing power supplied to the eighth radiation zone 56*g*, and a graph of a fourth power profile $P_4(t)$ 158 representing power supplied to the fourth radiation zone 56*c*.

Figure 5:
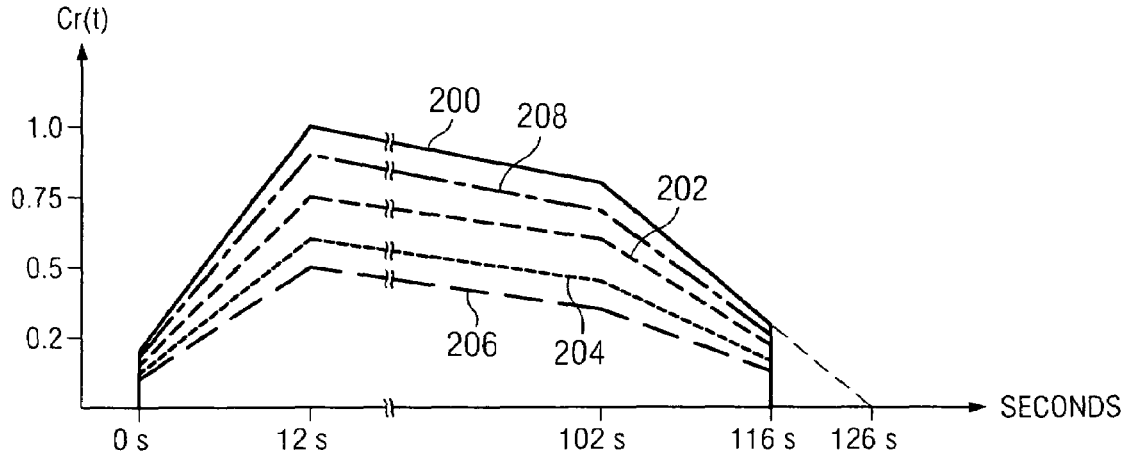
FIG. 5 is a graph of another ramping time function and other individual power profiles for radiation zones according to another embodiment of the disclosure.

Turning now to FIG. 5, a graph illustrates a second ramping time function $C_r(t)$ 200. In the second ramping time function $C_r(t)$ 200 differs from the first ramping time function $C_r(t)$ 150 in that initial value of $C_r(t)$ is 0.2 at time=0, when the printing plate enters the curing chamber 14. Additionally, the value of $C_r(t)$ linearly decreases from 1.0 to 0.75 over a 90 second time interval during the middle curing time interval, corresponding to the sustained curing interval of the curing scenario depicted in FIG. 4. Finally, the value of $C_r(t)$ at first linearly decreases at a rate that will ramp it from a value of 0.75 to 0.2 over a 24 second time interval, but at 116 seconds, the value of $C_r(t)$ drops immediately to a 0.2 value, for example in response to a signal from the second edge detector 24*b* indicating the printing plate has left the curing chamber 14. The curing scenario illustrated in FIG. 5 has been found to be beneficial when several printing plates are cured in succession. It is believed that the curing chamber 14 retains energy for at least a short time and hence less radiation is required to provide the desirable curing of the printing plate when the curing chamber 14 has recently been irradiated with energy.

For the exemplary curing scenario depicted in FIG. 5, the value of $C_s$ is 0.9 and the value of $P_{max}$ is 1.0 for the P(t) for each of the radiation zones 56*c*, 56*d*, 56*e*, 56*f*, and 56*g*. The weighting coefficient of the eighth radiation zone 56*g* $C_{w,8}$=0.5, the seventh radiation zone 56*f* $C_{w,7}$=0.6, the sixth radiation zone 56*e* $C_{w,6}$=0.6, the fifth radiation zone 56*d* $C_{w,5}$=0.8, and the fourth radiation zone 56*c* $C_{w,4}$=1.0. These weightings, used in the equation (1) above, lead to a graph of a fifth power profile $P_5(t)$ 202 representing power supplied to the fifth radiation zone 56*d*, a graph of a sixth power profile $P_6(t)$ 204 representing power supplied to the sixth radiation zone 56*e* and to the seventh radiation zone 56*f*, a graph of a seventh power profile n $P_7(t)$ 206 representing power supplied to the eighth radiation zone 56*g*, and a graph of an eighth power profile $P_8(t)$ 158 representing power supplied to the fourth radiation zone 56*c*.

Figure 6:
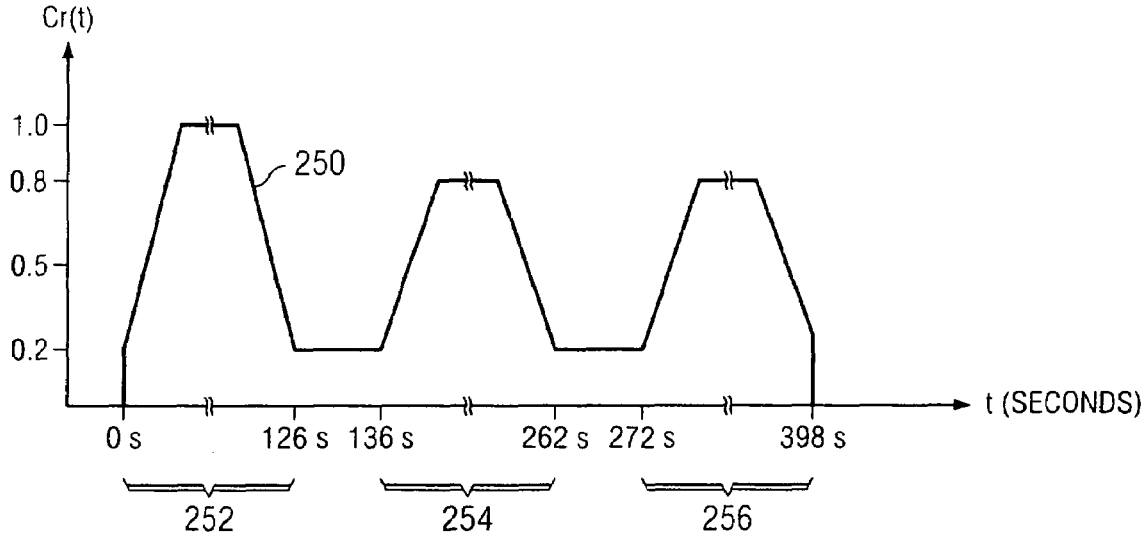
FIG. 6 is a graph of another ramping time function and other individual power profiles for radiation zones according to yet another embodiment of the disclosure.

Turning now to FIG. 6, a graph illustrates a third ramping time function $C_r(t)$ 250. This third ramping time function $C_r(t)$ is directed to curing three printing plates one right after another. Because the curing chamber 14 is expected to retain some energy from the radiation cycle associated with curing the first printing plate during a first time interval 252, and hence the maximum value of $C_r(t)$ during a second time interval 254 and a third time interval 256 may be 0.8.

The curing scenario creation tool may support defining an arbitrary ramping time function $C_r(t)$ as a sequence of pairs, such that $C_r(t)$ ramps up or down linearly between power/time pairs. Other curing scenario templates—in addition to the linear ramp-up, sustained, linear ramp-down template described in detail above—that promote easy definition of curing scenarios are also contemplated by the present disclosure. For example, the ramping time function $C_r(t)$ may contain a non-linear ramp-up and/or a non-linear ramp-down portion. The ramping time function $C_r(t)$ may ramp to a maximum power supply level, ramp down to an intermediate power supply level, sustain the intermediate power supply level for a time duration, and then ramp down to the powered off or minimum power supply level. Temperature input from one or more temperature sensors 26 located within or adjacent to the curing chamber 14 may be employed in some curing control scenarios.

Curing scenarios or recipes may be developed through an empirical process of trial and error in the field. For example, a plurality of imaged and developed printing plates may be cured using different recipes and the curing results of each different recipe inspected to determine the effectiveness of the recipes. The inspection may involve visually examining the printing plates for a characteristic discoloration, a "browning" discoloration, indicative of excessive irradiation. The discoloration may be uniform across the whole printing plate, indicative of general excess irradiation, or may appear only in limited regions of the printing plate, indicative of zones of excessive irradiation. In the case of general excess irradiation, the maximum scenario weighting coefficient $C_s$ may be reduced. In the case of zones of excessive irradiation, correlated radiation zones may be defined and the weighting coefficient $C_w$ for the energy radiators 54 within the radiation zone associated with excessive irradiation may be reduced. The inspection may involve manually handling the printing plates to determine if the malleability and/or the tensile strength and resistance to bending is altered relative to uncured printing plates.

A technician defining curing scenarios or recipes may interpolate between two related curing scenarios. Alternatively, the curing scenario creation tool may provide a capability to define a new curing scenario as an interpolation between two different curing scenarios which share the same general radiation template or functional form. Because prior art curing systems, for example convective heating ovens, may not have provided the capability to rapidly change energy levels within the curing chamber 14 and may not have provided the capability to differentially control heating across the surface area of the printing plate and between the top surface and the bottom surface of the printing plate, there may not be an existing pool of practical knowledge of how to tune curing scenarios or recipes, leaving the default method of trial and error refinement of curing scenarios or recipes.

One method of determine the cure state of a printing plate, for example to determine if the printing plate is cured or is not cured sufficiently, is to use a deletion pen in an attempt to erase a portion of the imaged printing plate. If the printing plate is not cured, the deletion pen may be effective to erase a portion of the imaged printing plate; if the printing plate is cured, the deletion pen is ineffective. This method is slow and is not suited to automation. Temperature sensitive dyes have been added to at least some printing plates to provide a color indication of the state of the printing plate cure to the human eye. In one case, a manufacturer of printing plates has selected temperature sensitive dyes in their printing plates to change from a blue color to a green color as seen by the human eye, to indicate the cure state of the printing plate based on observation by the human eye. This may be referred to as the color versus temperature function, or the color-temperature function, of the printing plate. The colors may vary between various types of chemical systems used for printing plates, but for a given type of plate a properly cured printing plate will have a substantially consistent color that is different from an uncured plate. The color of the temperature sensitive dyes have no influence on the printing properties of the printing plates. The printing properties are substantially mechanical in nature, that is the extent to which different areas adhere or do not adhere ink and/or water, and are determined by an image developed on the printing plate.

Determining the cure state of a printing plate may be of particular importance to the curing system 10 that employs the energy radiators 54 versus more conventional convection ovens. Convection ovens maintain a steady temperature to which printing plates are brought up to. Thus, measuring the temperature that printing plates are raised to in order to cure the printing plate is substantially achieved by measuring the temperature of the oven. In the case of the curing system 10 that employs the energy radiators 54, the nature of the heating process using direct radiation does not permit the temperature sensing of the air to determine the temperature of the printing plate. The air temperature does not remain constant, and there may be a significant difference between the printing plate temperature and the air temperature.

The controller 16 may use one or more color sensors 28, for example calorimeters, color densitometers, spectrophotometers, and/or other color sensors, to monitor the color of the printing plate either outside and/or inside the curing chamber 14 to assist controlling the energy radiators 54, the speed of the conveyer 12, and/or other printing plate preparation parameters. Color densitometers and spectrophotometers are capable of measuring colors and shades of colors to close and repeatable tolerances, for example to about two significant figures of accuracy or better. Such color sensors typically have a light source, typically white light, that illuminates the object being measured and sensors for measuring the amplitude of reflected light in a plurality of specific bandwidths of the visible spectrum. One specific bandwidth may be, for example, a fifty-five nanometer bandwidth from 500 nanometers to 555 nanometers. A color sensor provides a value indicating the intensity or magnitude of light in each of the specific bandwidths and each bandwidth may be identified as a color such as yellow, cyan, magenta, etc. As used herein, measuring a color or a color value means using a color sensor to provide a quantitative value representing the intensity or magnitude of light detected in one specific bandwidth or a plurality of specific bandwidths.

Human observation of color is subjective to the extent that people do not perceive the color of an object identically. While the color sensors 28 provide a quantitative indication of colors, the human observer provides a qualitative indication or assessment of color. The same person may perceive the color of an object differently at different times, for example when fatigued at the end of a workday versus when well rested at the beginning of the workday. Additionally, human observation of color may perceive color as a continuum, whereas a color densitometer or a spectrophotometer may measure color in a plurality of separate frequency bands. For example, a human sees a combination of blue and yellow light as green light, while a color sensor can provide quantitative measurement of the blue and yellow bands separately.

A first printing plate which has been cured and passed out of the curing chamber 14 may be monitored by an external color sensor 28, and the controller 16, in communication with the color sensor 28, may employ the colors information provided by the color sensor 28 to adjust the curing scenario to apply to the next printing plate to be cured. This constitutes a dynamic learning behavior of the controller 16 supported by the curing process feedback provided by the color sensor 28.

Alternately, or in addition, one or more color sensors 28 located inside the curing chamber 14 may monitor the color of the printing plate as it is cured, and the controller 16 may employ the color information to adjust the curing scenario of this same printing plate as it is cured. In an embodiment, a portion of the colors of the printing plate to be monitored may be conveyed by conduit means, for example by one or more fiber optic strands or other light pipe, to the color densitometers 28 and/or spectrophotometers 28 that may be located outside of the curing chamber 14. A standard irradiation may be conveyed from a remote source by similar conduit means, for example by one or more fiber optic strands or other light pipe, to illuminate the printing plate for measuring the color reflectance of the printing plate.

In a test, the following colors information was obtained from the color sensor 28 for uncured, low cure, and high cure states of an exemplary printing plate.

TABLE 1

Color Value Related to Cure State.

| | Uncured | Low-cure | High-cure |
|---|---|---|---|
| Black value | .69 | .60 | .64 |
| Cyan value | .84 | .62 | .62 |
| Magenta value | .59 | .58 | .68 |
| Yellow value | .63 | .76 | .91 |

The color values in the uncured column are the color values read by the color sensor 28 before the printing plate was cured, that is before its temperature was raised above temperatures normally experienced during shipping, storage, imaging and developing. The color values in the low-cure column are the color values read by the color sensor 28 when the printing plate is on the low-end of the cure range, that is the printing plate is just barely cured by having its temperature raised to the minimum temperature required to achieve a desirable cure. The low cure state may be considered to be the minimum acceptable cure amount. The color values in the high-cure column are the color values read by the color sensor 28 when the printing plate is at the high-end of the cure range, that is the printing plate is nearly over cured by having its temperature raised to the about a maximum temperature that is just below the temperature that would damage the printing plate. The high cure state may be considered to be the maximum acceptable cure amount, and that further curing, i.e. higher temperature, is undesirable as it may lead to decreased run-life of the printing plate. The color values therefore correlate with the temperature history of the printing plates and therefore correlate with the cure state of the printing plates. In this test, actual printing plate temperatures were measured in laboratory conditions that allowed accurate measurement of plate temperatures to determine the cure states as the color values were measured.

It was a surprise to find that the color values did not all change smoothly or at the same time as curing of the printing plate increased. For example, in the exemplary test case, the magenta color value measured by the color sensor 28 changed little until the printing plate achieved the high cure state. On the other hand, the cyan color value changed at the onset of the low cure state and remained relatively constant for increased cure state. The yellow color value changed relatively smoothly with increased cure state. These surprising results, surprising because examination with human vision alone did not dispose the inventors to anticipate this behavior within specific color values or spectral bandwidths, suggest a plurality of control scenarios. Examination with only human vision generally indicates only one change in color occurs when a plate is fully cured.

In a first control scenario, the controller 16 may be configured, for example with one or more configuration files, to adjust the power level and/or exposure time of the energy radiators 54 to maintain the yellow color value measured by the color sensor 28 at or about the middle value of the range of yellow color values from the low-cure state to the high-cure state, for example at or about 0.835 using the exemplary data presented in Table 1 above. The controller 16 may adjust the power level and/or exposure duration by small increments when the yellow color value measured by the color sensor 28 is close to the target middle value and by greater increments when the yellow color value is further from the target middle value. In a second control scenario, the controller 16 may use indications that curing is falling short of the low-cure state, e.g. the cyan value did not drop to the low cure value, or exceeding the high-cure state, e.g. the magenta value increased to or above its high cure value, to stop the process entirely until adjustment has been performed by an operator and the controller 16 is commanded to resume. Plates that did not reach the low cure value may be discarded or run through the curing system 10 again. Plates that exceed the high cure value will typically be discarded. Different colors versus temperature functions may apply for different printing plate types. These different functions may be defined by the one or more configuration files.

Other curing scenarios readily suggest themselves to those skilled in the art. It may be that adoption by the printing industry of the energy radiators 54 may lead to use of dyes in printing plates specifically adapted to control of the energy radiators 54. For example, a dye may be employed which provides a robust, repeatable, consistent temperature versus color value function. In such a case, a color sensor 28 may be developed that is adapted to sense only the subject color value, for example only the yellow color range, thereby leading to a lower cost color sensor 28.

There may be some curing variation among printing plates of the same type. This variation may be due to minor variations in supplier processes or differences of storage history of the subject plates or differences in the plate making environment leading up to the curing chamber, e.g. in an imager, developer or prebake oven. In an embodiment, the controller 16 may use one of the color sensors 28 to monitor the initial condition of the printing plate before imaging and use this information to increase or decrease energy levels for the subject printing plate. In an embodiment, the controller 16 may use one of the color sensors 28, located to monitor the colors of the printing plate before it enters the curing chamber 14, to provide an additional control parameter. The controller 16 may, in this embodiment, either increase or decrease energy levels for the subject printing plate based on the color of the printing plate, and hence the initial condition of the printing plate, prior to entering the curing chamber 14. In an embodiment, the controller 16 may allow a user to select from a plurality of types of printing plates, for example printing plates produced by different suppliers and/or different printing plates produced by the same supplier. The selection of printing plate types may promote the controller 16 adapting to different color versus temperature functions of the printing plates.

In an embodiment, the controller 16 may compose a heat image or a thermal image of the printing plate from the inputs from a plurality of temperature sensors 26 located within the curing chamber 14. The controller 16 may compare the heat image of the printing plate to an estimated heat image of the printing plate and control the power supplied to the energy radiators 54 to make the heat image of the printing plate conform with the estimated heat image of the printing plate. This processing may take account of heat accumulation by integrating with respect to time or otherwise time wise summing the temperature analogs of which the heat image of the printing plate is composed. In the case that this integrating approach is employed, the estimated heat image will correspondingly comprise a desirable or estimated temperature integrated with respect to time or time wise summing of the temperature analogs of which the heat image of the printing plate is composed. While this heat image based energy radiation control technique may be more complex and entail greater equipment expense, it may offer advantages in some commercial applications. Alternatively, the temperature sensors 26 may compose a temperature image of a first plate after it exits the curing chamber 14 and use the image to adjust power supplied to the energy radiators 54 for a second plate passing through the chamber 14.

The HMI 112 may also monitor and store energy use per printing plate data to perform real-time costing analysis and/or to make this information available to an offline data analysis system, for example a personal computer or laptop computer connected to a communication port of the HMI 112 or a common network to which both the HMI 112 and the personal computer or laptop computer have access.

The PLC 110 and HMI 112 described above may be implemented on any general-purpose computer, special purpose computer, or digital device appropriately programmed with sufficient processing power, memory resources, input/output ports, and network throughput capability to handle the necessary workload placed upon it. When the general purpose computer, special purpose computer, or other digital device is programmed by one skilled in the art with computer logic or program steps, the general purpose computer, special purpose computer, or digital device is able to provide the functionality described above. The special purpose computer may include programmable logical controllers. A programmable logic controller is designed to perform automation tasks and activities efficiently.

Figure 7A:
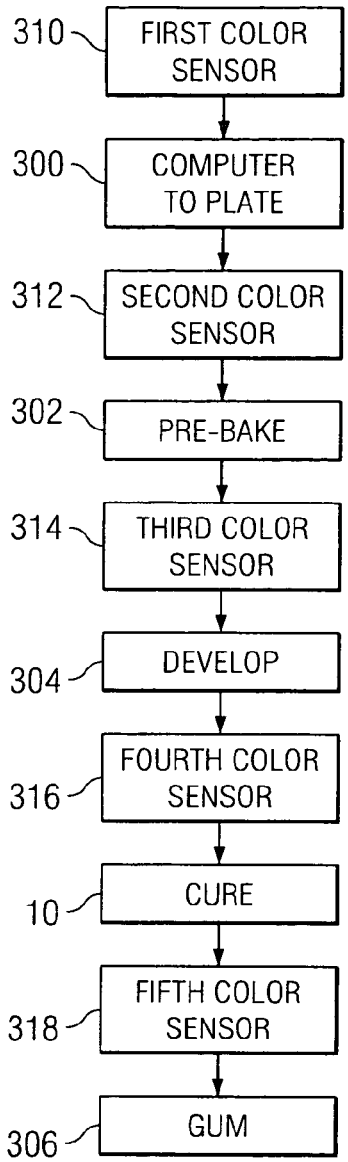
FIG. 7*a* illustrates an exemplary process using the curing system to produce a ready-to-use printing plate.

Turning now to FIG. 7*a*, an exemplary process for creating a ready-to-use printing plate using the curing system 10 is depicted. The process depicted in FIG. 7*a* may be employed with negative printing plate chemical processes. A computer-to-plate imager device 300 may image an unimaged printing plate. The imager device 300 typically images the printing plate using an infrared laser. The emulsion on the printing plate is responsive to shortwave infrared. In one embodiment, an imager device 300 images the printing plate with an infrared laser radiating at about 830 nanometers wavelength. The imager device 300 is not thought to substantially heat the printing plate when imaging the printing plate.

The now imaged printing plate may be moved to a pre-baking oven 302 to heat the imaged printing plate to a desirable temperature. In an embodiment, the curing system 10 may be employed in the role of the pre-baking oven 302. The pre-baked imaged printing plate may be moved to a developing device 304 where the imaged printing plate is developed, for example by using chemical processes. The developed printing plate may be moved to the curing system 10 to cure the developed printing plate. The cured printing plate may be moved to a gumming device 306 to apply a protective gum layer to the surface of the cured printing plate. A first color sensor 310 may measure the colors of the raw, unimaged printing plate to provide an indication of the initial condition of the printing plate. Due to variations in the process of manufacturing the printing plate, the process may adjust operating parameters based on the initial condition of the printing plate, for example adjusting the exposure of computer-to-plate imager device 300, by for example adjusting transport speed and/or instantaneous intensity. Likewise, the color values read by sensor 310 may be used to select curing scenarios for curing chambers 302 and 10 or otherwise adjust the total exposure of curing energy by adjusting transport speed and/or instantaneous energy level and/or the on time of energy radiators. A second color sensor 312 may measure the colors of the imaged printing plate. A third color sensor 314 may measure the colors of the printing plate after it has passed through the pre-baking oven 302. A fourth color sensor 316 may measure the colors of the printing plate after it has passed through the developing device 304. A fifth color sensor 318 may measure the colors of the printing plate after it has been cured by the curing system 10. In an embodiment, either the third color sensor 314 or the fourth color sensor 316 is employed but not both. In different embodiments, different combinations of the color sensors 310, 312, 314, 316, and 318 may be employed, for example to achieve different levels of process control precision and/or installation price points. The colors measured by the color sensors 310, 312, 314, 316, and 318 are used by the controller 16 to control the curing system 10 and/or the computer-to-plate imager device 300.

Figure 7B:
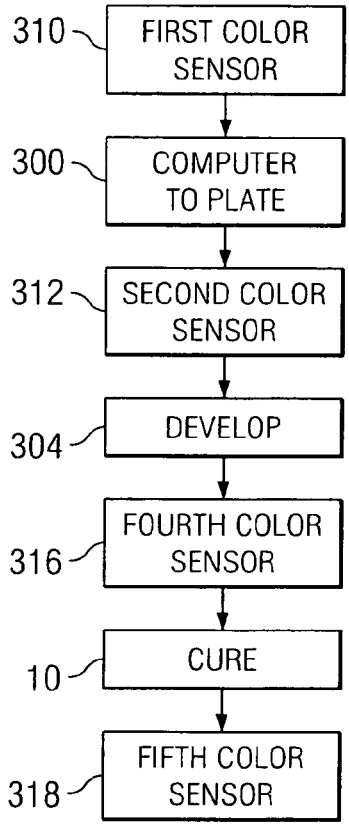
FIG. 7*b* illustrates another exemplary process using the curing system to produce a ready-to-use printing plate.

Turning now to FIG. 7*b*, an alternative exemplary process for creating a ready-to-use printing plate using the curing system 10 is depicted. The process depicted in FIG. 7*b* may be employed with positive printing plate chemical processes. In an embodiment, the first color sensor 310 may measure the colors of the raw, unimaged printing plate to provide an indication of the initial condition of the printing plate. Due to variations in the process of manufacturing the printing plate, the process may adjust operating parameters based on the initial condition of the printing plate, for example adjusting the computer-to-plate imager device 300. A computer-to-plate imager device 300 may image an unimaged printing plate. The imager device 300 typically images the printing plate using an infrared laser. The emulsion on the printing plate is responsive to shortwave infrared. In one embodiment, an imager device 300 images the printing plate with an infrared laser radiating at about 830 nanometers wavelength. The imager device 300 is not thought to substantially heat the printing plate when imaging the printing plate.

The second color sensor 312 may measure the colors of the imaged printing plate to provide an indication of the condition of the printing plate after imaging. The now imaged printing plate may be moved to a developing device 304 where the imaged printing plate is developed, for example by using chemical processes. A fourth color sensor 316 may measure the color of the printing plate after developing. In an embodiment, preferably either the second color sensor 312 or the fourth color sensor 316 is used but not both. The developed printing plate may be moved to the curing system 10 to cure the developed printing plate. The fifth color sensor 318 may measure the color of the printing plate after curing, providing a feedback to be used in controlling the processing of the following printing plate(s).

In an embodiment, the thresholds for determining that the printing plate is at the low-cure state or at the high-cure state may be based on a percentage of change from the uncured state measured, for example, by the first color sensor 310, the second color sensor 312, or the fifth color sensor 316. Alternatively, the thresholds for determining that the printing plate is at the low-cure state or at the high-cure state may be based on a fixed change or delta relative to the uncured state.

In an embodiment where the thresholds for determining the low-cure and high-cure states are based on a percentage of the initial uncured value, the threshold percentages, based on the exemplary data of Table 1, may have the following values:

TABLE 2

Cure Thresholds as Percentage of Uncured Values.

| | Uncured | Low-cure | High-cure |
|---|---|---|---|
| Black value | 100% | 87% | 100% |
| Cyan value | 100% | 73% | 73% |
| Magenta value | 100% | 100% | 115% |
| Yellow value | 100% | 121% | 144% |

When the initial uncured plate color values are known, for example by having been measured by a color sensor 310, 312, etc., the threshold values for low-cure state and high-cure state can be determined based on the threshold percentages. If the center of the yellow value range between low-cure and high-cure is used as a control set point, the set point may be about 132.5% in Table 2. An exemplary set of initial uncured plate color values and associated exemplary threshold values calculated based on the threshold percentages of Table 2 are provided in Table 3 below. If the center of the yellow value range between low-cure and high-cure is used as a control set point, the set point may be about 0.91 in Table 3.

TABLE 3

Cure Thresholds as Percentage of Exemplary Uncured Values.

| | Uncured | Low-cure | High-cure |
|---|---|---|---|
| Black value | .76 | .66 | .76 |
| Cyan value | .92 | .67 | .67 |
| Magenta value | .65 | .65 | .75 |
| Yellow value | .69 | .83 | .99 |

In an embodiment where the thresholds for determining the low-cure and high-cure states are based on a fixed increment of delta relative to the initial uncured value, the threshold increments, based on the exemplary data of Table 1, may have the following values:

TABLE 4

Cure Thresholds as Fixed Increment Versus Uncured Values.

| | Uncured | Low-cure | High-cure |
|---|---|---|---|
| Black value | 0 | −0.09 | −0.05 |
| Cyan value | 0 | −0.22 | −0.22 |
| Magenta value | 0 | 0 | +0.09 |
| Yellow value | 0 | +0.13 | +0.28 |

When the initial uncured plate color values are known, for example by having been measured by a color sensor 310, 312, etc., the threshold values for low-cure state and high-cure state can be determined based on the threshold increments. If the center of the yellow value range between low-cure and high-cure is used as a control set point, the set point may be about 0.205 in Table 4. An exemplary set of initial uncured plate color values and associated exemplary threshold values calculated based on the threshold increments of Table 4 are provided in Table 5 below. If the center of the yellow value range between low-cure and high-cure is used as a control set point, the set point may be about 0.8985 in Table 5.

TABLE 5

Cure Thresholds as Fixed Increment of Exemplary Uncured Values.

| | Uncured | Low-cure | High-cure |
|---|---|---|---|
| Black value | .76 | .67 | .71 |
| Cyan value | .92 | .70 | .70 |
| Magenta value | .65 | .65 | .74 |
| Yellow value | .69 | .82 | .97 |

In an embodiment, the values determined for the low-cure and high-cure thresholds may be limited to a value between 0.0 and 1.0 using either the percentage or the increment methods.

The above examples are based on one type of printing plate having a particular dye system. As noted above, various manufacturers use different dye systems since the dye systems are not a necessary part of the coating or emulsion used to create images on printing plates. However, since all such dye systems produce color changes that are perceptible by the human eye, it is expected that by use of color sensors as taught herein, quantitative color values can be measured and used to control a printing plate manufacturing process. As in the example above, each type of plate may be cured to various degrees or levels in laboratory type equipment and its color values may be read at each level of cure. Then as shown above, the measured values may be used to define setpoints and/or upper and lower limits for automatic control of a printing plate manufacturing process.

In an embodiment, the color sensor 28 may take readings from multiple zones of the printing plate, as for example by moving the color sensor 28 horizontally back and forth as the printing plate is moved out of the curing chamber 14. The controller 16 may adjust the maximum levels of zones of the energy radiators 54 based on the measurement of colors in zones of the printing plate. Alternatively, multiple color sensors 28 may be disposed to concurrently measure colors in zones of the printing plate.

When using convection ovens, the rate of producing printing plates may be limited by the time spent curing the printing plates in the convection ovens. The curing system 10 described above may cure the printing plate in much less time, possibly making the computer-to-plate imager device 300 the limiting factor on the rate of producing printing plates. To increase printing plate production, the speed of imager 300 may be increased, but this generally results in an overall reduction in the exposure of the image on the printing plate. The reduced exposure may not fully complete the imaging reaction in the plate coating, but may be enough to allow proper developing of the plates. It has been found that when the computer-to-plate imager device 300 employs infrared radiation, e.g. a laser, to image the printing plate, the curing system 10 produces sufficient radiation in the range used by the imager to complete the imaging reaction in the coating as well as sufficient heat to cure the printing plate, thereby increasing the rate of producing cured printing plates. In an embodiment, multiple computer-to-plate devices 300 may feed a single curing system 10.

Figure 8:
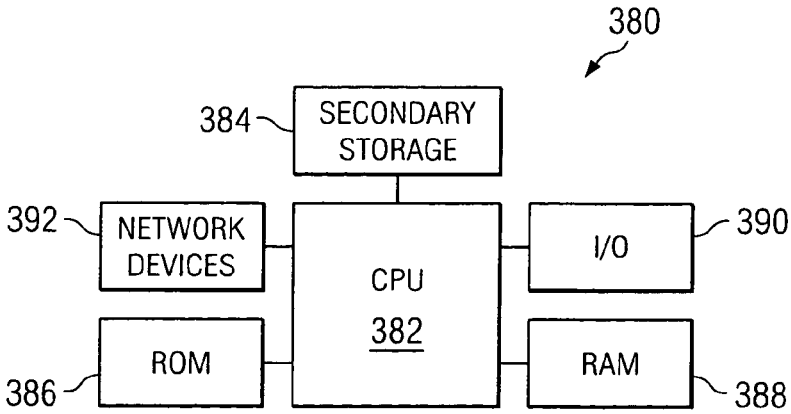
FIG. 8 illustrates an exemplary general purpose computer system suitable for implementing the several embodiments of the disclosure.

FIG. 8 illustrates a typical, general-purpose computer system suitable for implementing one or more embodiments disclosed herein. The computer system 380 includes a processor 382 (which may be referred to as a central processor unit or CPU) that is in communication with memory devices including secondary storage 384, read only memory (ROM) 386, random access memory (RAM) 388, input/output (I/O) 390 devices, and network connectivity devices 392. The processor may be implemented as one or more CPU chips.

The secondary storage 384 is typically comprised of one or more disk drives, tape drives, compact FLASH memory, or other storage device and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage. The RAM 388 is used to store volatile data and perhaps to store instructions. Access to both ROM 386 and RAM 388 is typically faster than to secondary storage 384.

I/O 390 devices may include printers, video monitors, liquid crystal displays (LCDs), touch screen displays (e.g. HMI 112), keyboards, keypads, switches, dials, mice, track balls, voice recognizers, card readers, paper tape readers, or other well-known input devices. The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as Global System for Mobile Communications (GSM) radio transceiver cards, and other well-known network devices. These network connectivity 392 devices may enable the processor 382 to communicate with an Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave Such information, which may include data or instructions to be executed using processor 382 for example, may be received from and outputted to the network, for example, in the form of a computer data baseband signal or signal embodied in a carrier wave. The baseband signal or signal embodied in the carrier wave generated by the network connectivity 392 devices may propagate in or on the surface of electrical conductors, in coaxial cables, in waveguides, in optical media, for example optical fiber, or in the air or free space. The information contained in the baseband signal or signal embedded in the carrier wave may be ordered according to different sequences, as may be desirable for either processing or generating the information or transmitting or receiving the information. The baseband signal or signal embedded in the carrier wave, or other types of signals currently used or hereafter developed, referred to herein as the transmission medium, may be generated according to several methods well known to one skilled in the art.

The processor 382 executes instructions, codes, computer programs, scripts which it accesses from hard disk, floppy disk, optical disk, compact FLASH memory (these may all be considered secondary storage 384), ROM 386, RAM 388, or the network connectivity devices 392.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein, but may be modified within the scope of the appended claims along with their full scope of equivalents. For example, the various elements or components may be combined or integrated in another system or certain features may be omitted, or not implemented.

Also, techniques, systems, subsystems and methods described and illustrated in the various embodiments as discrete or separate may be combined or integrated with other systems, modules, techniques, or methods without departing from the scope of the present disclosure. Other items shown or discussed as directly coupled or communicating with each other may be coupled through some interface or device, such that the items may no longer be considered directly coupled to each other but may still be indirectly coupled and in communication, whether electrically, mechanically, or otherwise with one another. Other examples of changes, substitutions, and alterations are ascertainable by one skilled in the art and could be made without departing from the spirit and scope disclosed herein.

What is claimed is:

1. A method for curing a printing plate, comprising:

heating a printing plate in a curing chamber;

measuring a plurality of separate color frequency bands of the printing plate with at least one color sensor; and controlling the curing chamber with an output signal from the color sensor.

2. A method for curing a printing plate according to claim 1, further comprising:

moving a first printing plate into and out of the curing chamber;

measuring at least one color of the first printing plate after it moves out of the curing chamber with a color sensor; and moving a second printing plate into the curing chamber.

3. A method for curing a printing plate according to claim 1, further comprising:

moving a printing plate into the curing chamber; and measuring at least one color of the printing plate before it moves into the curing chamber with a color sensor.

4. A method for curing a printing plate according to claim 1, further comprising:

moving a printing plate into and out of the curing chamber;

measuring at least one color of the printing plate before it moves into the curing chamber with a first color sensor;

measuring at least one color of the printing plate after it moves out of the curing chamber with a second color sensor; and controlling the curing chamber with output signals from the first color sensor and second color sensor.

5. A method for curing a printing plate-comprising:

heating a printing plate in a curing chamber;

moving the printing plate into and out of the curing chamber;

measuring at least one color of the printing plate before it moves into the curing chamber with a first color sensor;

measuring at least one color of the printing plate after it moves out of the curing chamber with a second color sensor; and controlling the curing chamber with the difference between the output signals from the first color sensor and the second color sensor.

6. A method for curing a printing plate according to claim 1 wherein the curing chamber comprises at least one energy radiator, further comprising:

adjusting the radiation from at least one energy radiator in the curing chamber.

7. A method for curing a printing plate according to claim 6, further comprising:

selecting a value of a color as a setpoint, if the output value of the color sensor is below the setpoint, increasing the radiation, and if the output value of the color sensor is above the setpoint, decreasing the radiation.

8. A method for curing a printing plate according to claim 1, further comprising:

measuring at least one color of the printing plate while it is in the curing chamber with a color sensor.

9. A method for curing a printing plate according to claim 1, further comprising:

moving a printing plate through the curing chamber; and adjusting the speed of moving the printing plate through the curing chamber.

10. A printing plate production system, comprising:

a curing chamber;

at least one color sensor having an output indicating a plurality of separate color values of a printing plate; and a controller receiving the output of the at least one color sensor and controlling the curing chamber.

11. A printing plate production system according to claim 10, wherein the curing chamber comprises at least one energy radiator and the controller controls the intensity of radiation produced by the at least one energy radiator.

12. A printing plate production system according to claim 10, further comprising:

a conveyor positioned to move a printing plate into, through and out of the curing chamber; and a color sensor positioned to measure a printing plate after it moves out of the curing chamber.

13. A printing plate production system according to claim 10, further comprising:

a conveyor positioned to move a printing plate into, through and out of the curing chamber; and a first color sensor positioned to measure a color value of a first printing plate before it moves into the curing chamber and having an output coupled to the controller.

14. A printing plate production system according to claim 13, further comprising:

a second color sensor positioned to measure a color value of the first printing plate after it moves out of the curing chamber and having an output coupled to the controller.

15. A printing plate production system, comprising:

a curing chamber;

a controller receiving an output of at least one color sensor and controlling the curing chamber;

a conveyor positioned to move a printing plate into, through and out of the curing chamber;

a first color sensor positioned to measure at least one color value of a first printing plate before it moves into the curing chamber and having an output coupled to the controller; and a second color sensor positioned to measure at least one color value of the first printing plate after it moves out of the curing chamber and having an output coupled to the controller, wherein the controller determines the difference between the color values of the first printing plate measured by the first color sensor and the second color sensor.

16. A printing plate production system according to claim 10, further comprising:

a conveyor positioned to move a printing plate through the curing chamber;

the controller coupled to the conveyor and controlling conveyor speed.

17. A printing plate production system according to claim 10, further comprising:

an imager exposing an image on a printing plate;

a first color sensor positioned to measure a color of the printing plate before it is exposed in the imager and having an output coupled to the controller;

a second color sensor positioned to measure a color of the printing plate after it is exposed and before it moves into the curing chamber and having an output coupled to the controller; and a third color sensor positioned to measure a color of the printing plate after it moves out of the curing chamber and having an output coupled to the controller.

18. A printing plate production system, comprising:

a curing chamber;

at least one color sensor having an output indicating at least one color value of a printing plate;

a controller receiving the output of the at least one color sensor and controlling the curing chamber;

an imager exposing an image on a printing plate;

a first color sensor positioned to measure a color of the printing plate before it is exposed in the imager and having an output coupled to the controller;

a second color sensor positioned to measure a color of the printing plate after it is exposed and before it moves into the curing chamber and having an output coupled to the controller; and a third color sensor positioned to measure a color of the printing plate after it moves out of the curing chamber and having an output coupled to the controller, wherein the controller is coupled to the imager and provides a control signal to the imager.

19. A printing plate production system according to claim 10, wherein the at least one color sensor is selected from the group of a colorimeter, a color densitometer, and a spectrophotometer.

20. A printing plate production system according to claim 10, wherein the at least one color sensor is positioned to measure a color of a printing plate in the curing chamber.

21. A printing plate production system, comprising:

a printing plate imager, a printing plate developer, a curing chamber;

at least one color sensor having an output indicating a plurality of separate color values of a printing plate; and a controller receiving the output of the at least one color sensor and controlling at least one operating parameter of at least one of the printing plate imager, the printing plate developer, and the curing chamber.

22. A printing plate production system according to claim 21, wherein the operating parameter is selected from temperature, radiated energy, transport speed and exposure time.

* * * * *